US010642203B2

(12) United States Patent
Kihara et al.

(10) Patent No.: US 10,642,203 B2
(45) Date of Patent: May 5, 2020

(54) IMAGE FORMING APPARATUS

(71) Applicant: CANON KABUSHIKI KAISHA, Tokyo (JP)

(72) Inventors: Takayoshi Kihara, Mishima (JP); Shinichi Agata, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 222 days.

(21) Appl. No.: 15/942,246

(22) Filed: Mar. 30, 2018

(65) Prior Publication Data

US 2018/0292773 A1 Oct. 11, 2018

(30) Foreign Application Priority Data

Apr. 10, 2017 (JP) ..... 2017-077614
Mar. 7, 2018 (JP) ..... 2018-041225

(51) Int. Cl.
*G03G 15/00* (2006.01)
*G03G 15/06* (2006.01)
*G03G 15/08* (2006.01)

(52) U.S. Cl.
CPC ..... *G03G 15/50* (2013.01); *G03G 15/065* (2013.01); *G03G 15/0806* (2013.01); *G03G 15/0808* (2013.01); *G03G 15/0877* (2013.01)

(58) Field of Classification Search
CPC ..... G03G 15/50; G03G 15/0806; G03G 15/0808; G03G 15/065; G03G 15/0877; G03G 15/0266
See application file for complete search history.

(56) References Cited

U.S. PATENT DOCUMENTS

2017/0329263 A1* 11/2017 Sugiura ..... G03G 15/1665

FOREIGN PATENT DOCUMENTS

JP 09-329958 A 12/1997

* cited by examiner

*Primary Examiner* — Susan S Lee
(74) *Attorney, Agent, or Firm* — Canon U.S.A., Inc. IP Division

(57) ABSTRACT

An image forming apparatus includes a control unit that controls an electric potential difference between a development roller and a supply roller in such a manner that force in a direction from the supply roller toward the development roller acts on toner in a section of an image forming region extending from a leading edge of a first image forming region toward a trailing edge thereof. The control unit controls the electric potential difference in such a manner that force acting on the toner becomes smaller in a section extending from a switching point, which is located at a position obtained by returning from a leading edge of a second image forming region to the first image forming region by a distance equal to or greater than a circumferential length of the development roller, to the trailing edge of the first image forming region.

9 Claims, 6 Drawing Sheets

DEVELOPMENT ROLLER BIAS
SUPPLY ROLLER BIAS
END OF IMAGE FORMATION FOR FIRST IMAGE
START OF IMAGE FORMATION FOR SECOND IMAGE
CORRESPONDING TO ONE CYCLE OF ROTATION OF DEVELOPMENT ROLLER

P

P
TIME

IMAGE FORMING APPARATUS

BACKGROUND OF THE INVENTION

Field of the Invention

Aspects of the present disclosure relate to an electrophotographic image forming apparatus, such as a copying machine, a printing apparatus, and a facsimile apparatus.

Description of the Related Art

There has been known a development device that makes an electrostatic latent image visible using non-magnetic one-component toner, including a development roller, which serves as a developer bearing member that bears and conveys toner, and a supply roller, which serves as a developer supply member that supplies toner to the development roller. In such a development device, mechanical sliding-contact and friction between the supply roller and the development roller causes toner to be supplied to the development roller while being subjected to triboelectric charging. The supplied toner, with the toner layer thickness on the development roller regulated to a given amount by a developer regulation member, is conveyed to a developing area, which is a proximity area close to a photosensitive drum serving as an electrostatic latent image bearing member, and is thus used to make an electrostatic latent image visible as a toner image.

The toner remaining on the development roller without being used for development in the developing area (hereinafter referred to as "development residual toner") is scraped off from on the development roller by mechanical sliding-contact and friction between the supply roller and the development roller at an abutment portion between the development roller and the supply roller. At the same time, toner is supplied from the supply roller to the development roller. On the other hand, the scraped-off toner is mixed with toner present inside the supply roller and at the periphery thereof.

In such a conventional development device, in the case of a printing pattern in which, for example, a background color is printed at a halftone density, there may occur a phenomenon in which the halftone density differs between an area just after the area in which a solid image is output and an area in which no solid image is output (hereinafter referred to as a "development ghost"). The development ghost is caused by a difference in toner charge amount due to a difference in the printing pattern to be developed by the development roller, and is likely to occur in a case where the scraping-off capability of the supply roller is low.

To address this issue, if measures to strengthen mechanical scraping-off of the supply roller are taken, although a development ghost is reduced, mechanical sliding-contact and friction between the development roller and the supply roller increases, so that toner deterioration is accelerated. If toner deterioration, in other words, liberation or burial of an external additive on the surface of toner, is accelerated, an increase in cohesion degree or a decrease in electrification performance is caused, and a problem such as toner filming, in which toner melts and adheres to the surface of the development roller, arises, so that the operating life the development device is hindered from being lengthened. Therefore, a method other than strengthening mechanical sliding-contact and friction is required to prevent or reduce the occurrence of a development ghost.

Therefore, as a method for preventing or reducing the occurrence of a development ghost, it has been considered that control is performed to change a bias between the development roller and the supply roller and cause development residual toner on the development roller to peel off due to electrostatic force. However, in such a case, if a bias to cause development residual toner to peel off is applied, when an image with a high printing ratio, such as an entire solid image, is printed, image missing due to the insufficiency of toner supply amount (hereinafter referred to as a "solid-image followability defect") is liable to occur.

To address this issue, a method of applying a bias used to provide an electric potential difference between the development roller and the supply roller and supplying toner from the supply roller to the development roller or collecting toner on the development roller to the supply roller by electrostatic force has been usually performed.

In a configuration in which an inter-sheet distance employed during continuous printing is set to a distance equal to or longer than that corresponding to one cycle of rotation of the development roller, a method discussed in Japanese Patent Application Laid-Open No. 9-329958 sets the supply roller to a ground potential in such a way as not to allow a toner charge amount on the development roller to increase during image non-formation between adjacent sheets. Then, the method performs control to apply a bias in such a way as to form a toner layer on the development roller during image formation. In this way, in an area in which a toner layer on the development roller faces a space between adjacent sheets, the method sets a voltage which is to be applied to the supply roller to a ground potential during at least a period corresponding to one cycle of rotation of the development roller. In this way, the method causes the toner which has been conveyed a number of times on the development roller and has then increased in toner charge amount to be electrically scraped off by the supply roller.

Moreover, during image formation, the method performs bias control in such a way as to allow toner to be supplied from the supply roller onto the development roller, thus aiming at preventing or reducing a "solid-image followability defect", which is caused by the insufficiency of toner supply amount in a case where an image with a high printing ratio, such as an entire solid image, is printed.

SUMMARY OF THE INVENTION

For example, one embodiment of present disclosure provides an image forming apparatus including a rotatable developer bearing member configured to bear a developer, a development bias application unit that applies, to the developer bearing member, a development bias used to develop an electrostatic latent image, a supply roller to which a supply bias is applied by a supply bias application unit to supply the developer to the developer bearing member. The image forming apparatus is capable of forming an image in each of a first image forming region which corresponds to a first recording material and a second image forming region which is located at an interval less than a circumferential length of the developer bearing member and corresponds to a second recording material which is conveyed following the first recording material. A control unit controls an electric potential difference between the developer bearing member and the supply roller in such a manner that force in a direction from the supply roller toward the developer bearing member acts on the developer in a section of an image forming region extending from a leading edge of the first image forming region toward a trailing edge thereof. The control unit controls an electric potential difference between the developer bearing member and the supply roller in such a manner that force in a direction from the supply roller toward the developer bearing member acting on the developer becomes smaller in a section extending from a switching point, which is located at a position obtained by returning from a leading edge of the second image forming region to the first image forming region by a distance equal to or greater than the circumferential length of the developer bearing member, to the trailing edge of the first image forming region.

Further features and aspects of the present disclosure will become apparent from the following description of numerous example embodiments with reference to the attached drawings.

DESCRIPTION OF THE EMBODIMENTS

Figure 1:
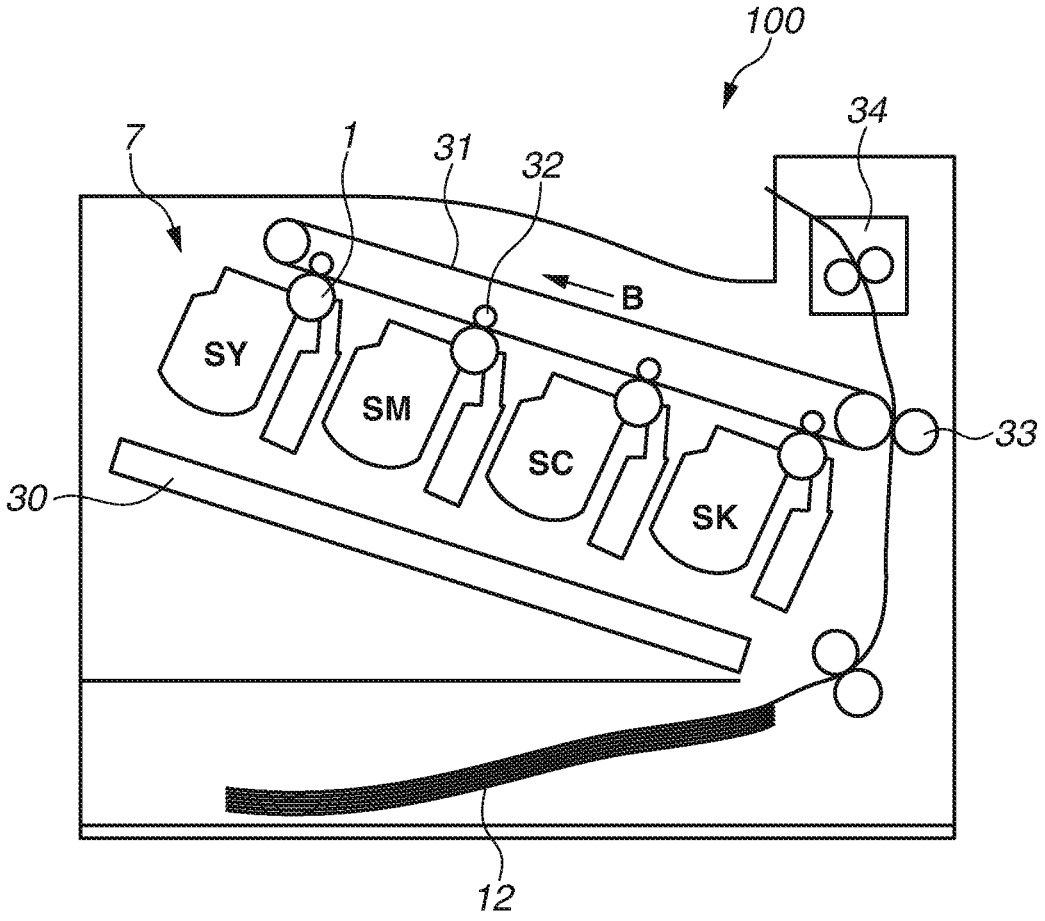
FIG. 1 is an outline diagram of an image forming apparatus provided for use in describing an example embodiment of the invention.

Recently, with the advance of market diversification, a further improvement in throughput productivity has been required. To prevent or reduce running noise of an image forming apparatus or temperature rising inside the apparatus with respect to further speed-up, a configuration aiming at improving productivity by shortening a distance between adjacent recording materials than ever before while keeping process speed-up of the apparatus to a minimum is being considered.

However, if the distance becomes shorter than a distance corresponding to one cycle of rotation of the development roller, an effect of the supply bias causing toner at the image non-forming region to peel off between adjacent recording materials is not sufficient, so that a development ghost may be made worse depending on printing patterns during image formation.

Therefore, in a case where the distance between adjacent recording materials is shortened and the distance between adjacent recording materials is made shorter than a distance corresponding to one cycle of rotation of the development roller, to aim at reducing a development ghost, it is conceivable that an application bias for the supply roller is set to cause an electric potential difference in a direction to peel off toner from the development roller to the supply roller. In this way, a configuration aiming at reducing a development ghost by applying, to the supply roller, a bias used to perform control to peel off toner at least in an amount corresponding to one cycle of rotation of the development roller before starting of image formation for the second image was considered.

However, in such a configuration capable of reducing or preventing a development ghost, as a result of verification, it was revealed that image missing might occur in an upstream-side region in the recording material conveyance direction. In other words, if the application bias is caused to vary in a direction to cause toner to be urged from the development roller to the supply roller, image missing may occur at the trailing edge portion of an image forming region due to the insufficiency of toner originally required for image formation.

Thus, in a configuration in which the distance between adjacent recording materials during continuous printing is set shorter than the circumferential length of the development roller, a mechanism for satisfying both reducing a development ghost and preventing image missing at an image trailing edge portion is described in detail.

Various example embodiments, features, and aspects of the disclosure will be described in detail below with reference to the drawings. However, it is noted that the size, material, shape, and relative position of each constituent component described in the following example embodiments can be changed as appropriate according to configurations of apparatuses to which the invention is applied or various conditions thereof. In other words, unless otherwise specifically described, the scope of the disclosure should not be construed to be limited only to those.

[Example Image Forming Apparatus]

An overall configuration of an electrophotographic image forming apparatus (an image forming apparatus) according to an example embodiment of the disclosure is described with reference to FIG. 1. FIG. 1 is a sectional view of an image forming apparatus 100 according to the present example embodiment. The image forming apparatus 100 in the present example embodiment is a full-color laser beam printer employing an in-line method and an intermediate transfer method. The image forming apparatus 100 is capable of forming a full-color image on a recording material (for example, recording paper, plastic sheet, or cloth) according to image information. The image information is input from an image reading device connected to the image forming apparatus body or a host device, such as a personal computer (PC), connected to the image forming apparatus body in such a way as to be able to perform communication, to the image forming apparatus body. In the image forming apparatus 100, process cartridges 7 are mounted as a plurality of image forming units SY, SM, SC, and SK, which are configured to respectively form images of yellow (Y), magenta (M), cyan (C), and black (K). In the present example embodiment, the image forming units SY, SM, SC, and SK are arranged in a line in a direction intersecting with the vertical direction.

Each process cartridge 7 is detachably mounted to the image forming apparatus 100 via a mounting unit, such as a mounting guide and a positioning member, provided in the image forming apparatus body. In the present example embodiment, the process cartridges 7 of respective colors have approximately the same shape, and toners of yellow (Y), magenta (M), cyan (C), and black (K) are respectively contained in the process cartridges 7 of respective colors.

Figure 2:
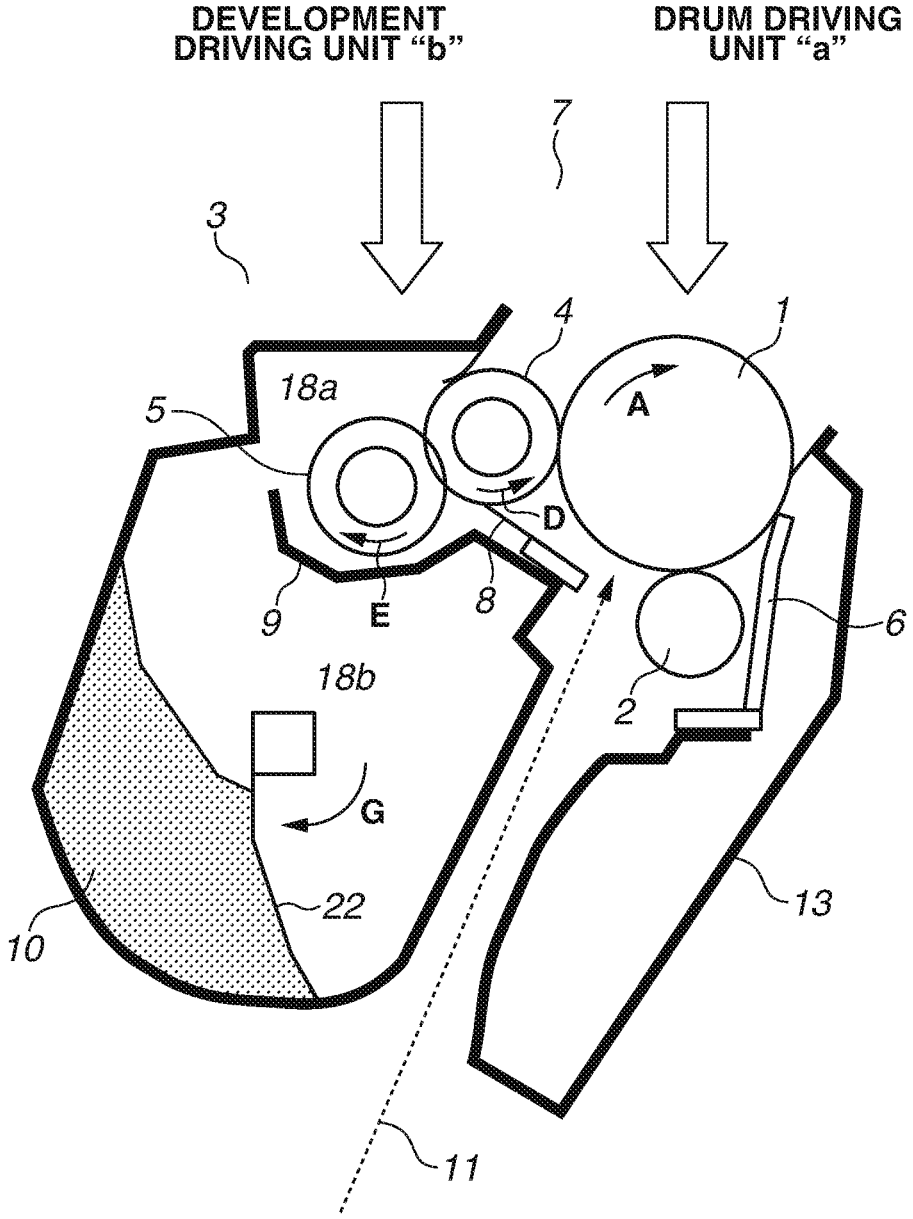
FIG. 2 is an outline diagram of a process cartridge in describing an example embodiment of the invention.
Figure 6:
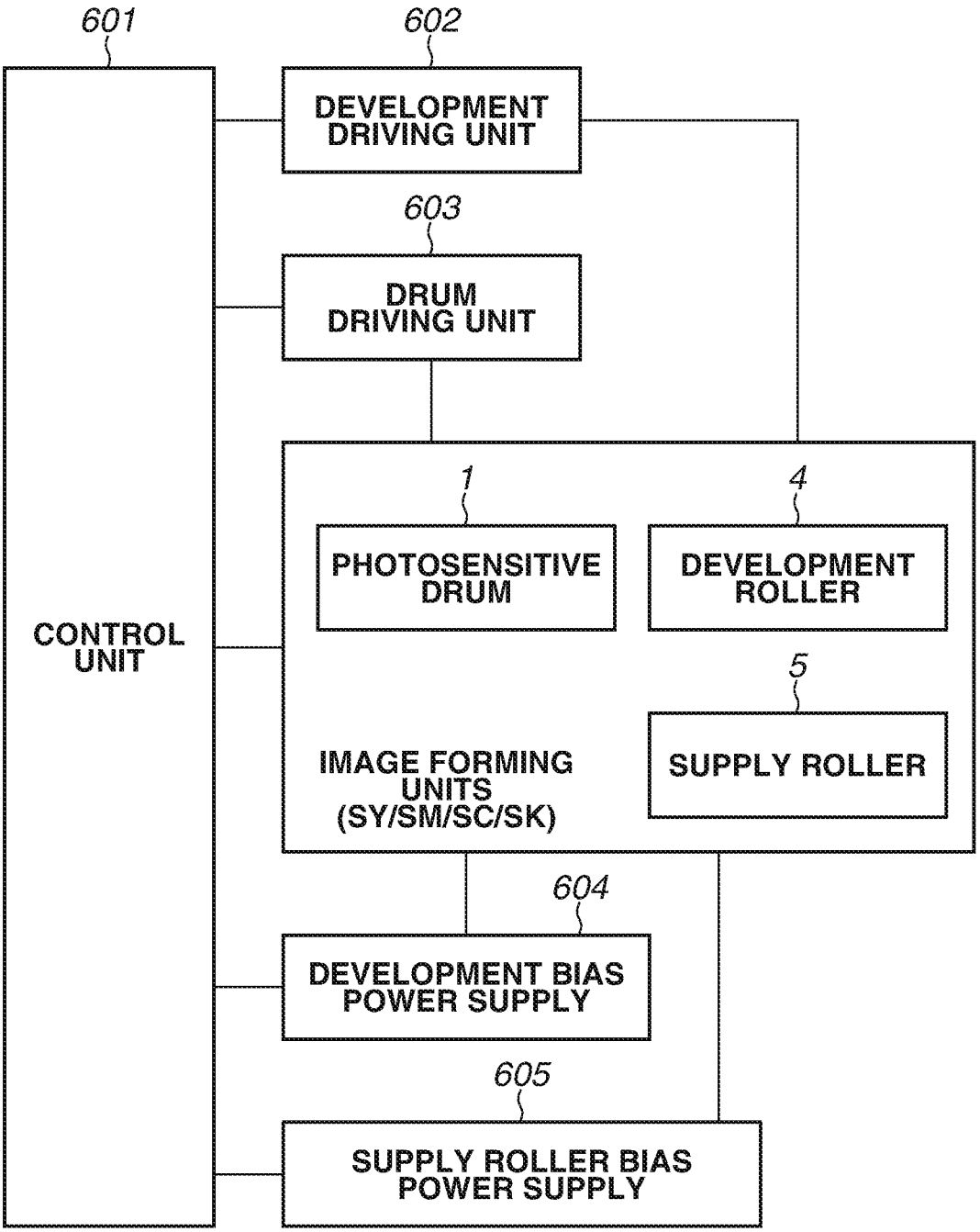
FIG. 6 is a block diagram of an image forming apparatus provided for use in describing an example embodiment of the invention.

A photosensitive drum 1 is driven to rotate by a drum driving unit (drive source) illustrated in FIG. 6. A scanner unit (exposure device) 30 is mounted in the vicinity of the photosensitive drum 1. As illustrated in FIG. 2, the scanner unit 30 is an exposure unit which radiates laser light 11 according to image information to form an electrostatic image (electrostatic latent image) on the photosensitive drum 1. Writing start of laser exposure is performed with a position signal in a polygon scanner, called a beam detection (BD) signal, for every scanning line with respect to a main scanning direction (a direction perpendicular to the conveyance direction of the recording material 12). On the other hand, with respect to a sub-scanning direction (the conveyance direction of the recording material 12), writing start of laser exposure is performed at a delay of a predetermined time from a TOP signal, which originates from a switch (not illustrated) in the conveyance path of the recording material 12. With this, in the four process stations Y, M, C, and K, laser exposure can be constantly performed at the same position on the photosensitive drum 1.

An intermediate transfer belt 31, which serves as an intermediate transfer member for transferring a toner image on the photosensitive drum 1 to the recording material 12, is mounted in such a way as to face the four photosensitive drums 1.

The intermediate transfer belt 31, which is formed in the shape of an endless belt as an intermediate transfer member, abuts on all of the photosensitive drums 1, and moves in a circulating manner (revolves) in the direction of arrow B illustrated in FIG. 1 (counterclockwise direction).

On the side of an inner circumferential surface of the intermediate transfer belt 31, four primary transfer rollers 32, serving as a primary transfer unit, are arranged side by side in a line in such a way as to face the respective photosensitive drums 1. Then, a bias with a polarity opposite to a normal charging polarity of toner is applied to the primary transfer rollers 32 from a primary transfer bias power supply (high-voltage power supply) serving as a primary transfer bias application unit (not illustrated). With this, a toner image on the photosensitive drum 1 is transferred (primarily transferred) onto the intermediate transfer belt 31. For example, at the time of formation of a full-color image, the above-mentioned process is sequentially performed in the image forming units SY, SM, SC, and SK, so that toner images of respective colors are sequentially superposed on each other and primarily transferred onto the intermediate transfer belt 31.

Moreover, on the side of an outer circumferential surface of the intermediate transfer belt 31, a secondary transfer roller 33 serving as a secondary transfer unit is mounted.

Then, the recording material 12 is conveyed to the secondary transfer unit in synchronization with the movement of the intermediate transfer belt 31, and a bias with a polarity opposite to a normal charging polarity of toner is applied to the secondary transfer roller 33 from a secondary transfer bias power supply (high-voltage power supply) serving as a secondary transfer bias application unit (not illustrated). With this, in cooperation with the action of the secondary transfer roller 33, which abuts on the intermediate transfer belt 31 via the recording material 12, toner images of four colors on the intermediate transfer belt 31 are collectively secondarily transferred onto the recording material 12.

The recording material 12 having toner images transferred thereto is conveyed to a fixing device 34 serving as a fixing unit. Heat and pressure are applied to the recording material 12 by the fixing device 34, so that toner images are fixed to the recording material 12.

[Example Process Cartridge]

An overall example configuration of the process cartridge 7, which is mounted in the image forming apparatus in the present example embodiment, is now herein described.

FIG. 2 is a sectional (principal section) view of the process cartridge 7 in the present example embodiment, as viewed along the longitudinal direction (rotation axis line direction) of the photosensitive drum 1. Furthermore, the configurations and operations of the process cartridges 7 for respective colors are substantially the same except for the types (colors) of developers contained therein.

The process cartridge 7 includes a photosensitive unit 13, which includes, for example, a photosensitive drum 1, and a development unit 3, which includes, for example, a development roller 4.

The photosensitive drum 1 is attached to the photosensitive unit 13 via a bearing (not illustrated) in such a way as to be rotatable. Upon receiving a driving force from a drive motor serving as a photosensitive drum driving unit (drive source "a"), the photosensitive drum 1 is driven to rotate in the direction of arrow A illustrated in FIG. 2 according to an image forming operation.

Moreover, a charging roller 2 and a cleaning member 6 are mounted in the photosensitive unit 13 in such a way as to contact the circumferential surface of the photosensitive drum 1. A bias sufficient to place optional electric charge onto the photosensitive drum 1 from a charging bias power supply (high-voltage power supply) serving as a charging bias application unit (not illustrated) is applied to the charging roller 2. In the present example embodiment, a bias which is applied in such a manner that the electric potential on the photosensitive drum 1 (charging electric potential: Vd) becomes −500 V is set.

Laser light 11 is radiated from the scanner unit 30 based on image information, so that an electrostatic image (electrostatic latent image) is formed on the photosensitive drum 1.

On the other hand, the development unit 3 includes a development chamber 18*a* and a developer containing chamber 18*b*, and the developer containing chamber 18*b* is located below the development chamber 18*a*. A toner containing portion 10, in which toner serving as a developer is contained, is provided inside the developer containing chamber 18*b*. In the present example embodiment, the normal charging polarity of this toner is negative polarity, and, hereinafter, the description is made with respect to the case of using negatively-charged toner. However, the present example embodiment is not limited to using negatively-charged toner.

Furthermore, a developer conveyance member 22, which is used to convey this toner to the development chamber 18*a*, is provided in the developer containing chamber 18*b*, and is configured to rotate in the direction of arrow G illustrated in FIG. 2 to convey toner to the development chamber 18*a*.

The development roller 4 serving as a developer bearing member, which is in contact with the photosensitive drum 1 and rotates in the direction of arrow D illustrated in FIG. 2 by receiving drive force from a drive motor serving as a development driving unit (drive source) illustrated in FIG. 6, is provided in the development chamber 18*a*. In the present example embodiment, both the development roller 4 and the photosensitive drum 1 rotate in such a manner that the respective surfaces thereof move in the same direction (in a parallel direction) at the respective opposite portions (contact portions) thereof (make with-rotation). Moreover, a bias sufficient to develop and make visible an electrostatic latent image on the photosensitive drum 1 as a toner image is applied to the development roller 4 from a development bias power supply (high-voltage power supply) serving as a development bias application unit illustrated in FIG. 6. Furthermore, with respect to a direction perpendicular to the conveyance direction of the recording material 12, the narrower one of a width available for formation of an electrostatic latent image on the photosensitive drum 1 and a width of the development roller 4 available for development of an electrostatic latent image on the photosensitive drum 1 serves as the width of an image forming region. On the other hand, with respect to the conveyance direction of the recording material 12, a predetermined interval (an image non-forming region) is provided at each of the upstream side and the downstream side in the conveyance direction, and a width between the predetermined intervals serves as the width of an image forming region.

Moreover, a supply roller 5, which supplies toner conveyed from the developer containing chamber 18*b* to the development roller 4, and a regulation blade (regulation member) 8, which is used to perform the regulation of coat amount and the application of electric charge with respect to toner on the development roller 4 supplied from the supply roller 5, are mounted inside the development chamber 18*a*.

Next, configurations of the development roller 4, the supply roller 5, and the regulation blade 8 serving as a regulation member are described in detail.

The development roller 4 has a diameter of 15 mm, which is a roller configured by forming a base layer of silicone rubber on a conductive core metal with a diameter of 6 mm and forming urethane rubber as a surface layer on the base layer. Furthermore, the volume resistance of the development roller 4 can include resistance of 10E4 ($10^4$) Ω to 10E12 ($10^{12}$) Ω.

The supply roller 5 has a diameter of 15 mm, which is an elastic sponge roller configured by forming a foam layer on a conductive core metal with a diameter of 6 mm, and is arranged in such a way as to form a predetermined contact portion on the circumferential surface of the development roller 4 at the opposite portion relative to the development roller 4. The drive motor serving as a development driving unit (drive source "b") transmits drive force to each of the development roller 4 and the supply roller 5, and, in response to such transmission, the supply roller 5 rotates relative to the development roller 4 in the direction of arrow E illustrated in FIG. 2. In the present example embodiment, the development roller 4 and the supply roller 5 are driven to rotate at 100 revolutions per minute (rpm) and at 200 rpm, respectively, and the development roller 4 and the supply roller 5 are configured to rotate in such a manner that the respective surfaces thereof move in the same direction (in a parallel direction) at the respective opposite portions (contact portions) thereof (make with-rotation). Moreover, the supply roller 5 used in the present example embodiment has a resistance value of $4\times10^6\Omega$ and a hardness value of 190 gram-force (gf). However, the hardness of the supply roller 5 in the present example embodiment is a value obtained by measuring a load at which a flat plate with a longitudinal width of 50 mm has been caused to intrude 1 mm from the surface of the supply roller 5.

The regulation blade 8 is a stainless-steel (SUS) plate made of metal with a thickness of 0.1 mm, and is arranged to be in contact with the development roller 4 in such a manner that the free end of the regulation blade 8 corresponds to the upstream side in the rotation direction of the development roller 4. The regulation blade 8 used in the present example embodiment is a member obtained by performing a cutting process on the tip of the SUS plate in conformity with the abutment surface of the development roller 4.

A bias is applied to the supply roller 5 from a supply roller bias power supply (high-voltage power supply) serving as a supply bias application unit illustrated in FIG. 6. In a case where a value obtained by subtracting the value of a negative bias to be applied to the development roller 4 from the value of a negative bias to be applied to the supply roller 5 has the same polarity as the normal charging polarity of toner, a force in a direction for urging from the supply roller 5 to the development roller 4 acts on the toner at the abutment portion between the supply roller 5 and the development roller 4. Conversely, in a case where a value obtained by subtracting the value of a negative bias to be applied to the development roller 4 from the value of a negative bias to be applied to the supply roller 5 has a polarity opposite to the normal charging polarity of toner, a force for urging from the development roller 4 to the supply roller 5 acts on the toner.

Moreover, an electric potential difference (absolute value) between the development roller 4 and the supply roller 5 is made gradually larger, and is made to vary in such a direction that a force acting on toner in a direction for urging from the supply roller 5 to the development roller 4 becomes gradually stronger. As a result, with regard to toner in the supply roller 5, while a force for holding the toner at the supply roller 5 is weakening, a force for supplying the toner to the development roller 4 is strengthening. Along with this, out of toners present inside and on the surface of the supply roller 5, toners starting with toner higher in responsiveness to an electric potential difference are gradually supplied to the development roller 4.

The toner supplied to the development roller 4 by the supply roller 5 enters an abutment portion at which the regulation blade 8 and the development roller 4 are in contact with each other, according to the rotation of the development roller 4 in the direction of arrow D, and is then subjected to triboelectric charging by sliding-contact and friction between the surface of the development roller 4 and the regulation blade 8, and, at the same time, the layer thickness of the toner is regulated. The regulated toner on the development roller 4 is conveyed to the opposite portion with the photosensitive drum 1 according to the rotation of the development roller 4, and is then used to develop and make visible a toner image on the photosensitive drum 1 as a toner image.

The toner remaining on the development roller 4 without being used for development in the developing area (hereinafter referred to as "development residual toner") enters a contact abutment portion with the supply roller 5 according to the rotation of the development roller 4 in the direction of arrow D. Part of the development residual toner is collected by the supply roller 5 according to mechanical sliding-contact and friction between the development roller 4 and the supply roller 5 and an electric potential difference between the development roller 4 and the supply roller 5, and is then mixed with toner in the development chamber 18*a* and toner carried by the supply roller 5. On the other hand, toner remaining on the development roller 4 without being collected by the supply roller 5 out of the development residual toner is given an electric charge by sliding-contact and friction with the supply roller 5, and, at the same time, is mixed with new toner supplied from the supply roller 5.

[Example Block Diagram]

An example block diagram of the image forming apparatus 100 is described with reference to FIG. 6. A controller 601 serving as a control unit includes, for example, a central processing unit, which is a central element for performing arithmetic processing, a memory, such as a read-only memory (ROM) and a random access memory (RAM), serving as a storage unit, and an input-output interface, which performs inputting and outputting of information with peripheral devices. The RAM stores, for example, various control parameters and computation results, and the ROM stores control programs.

At least a development driving unit 602, a drum driving unit 603, a development bias power supply 604, and a supply roller bias power supply 605 are electrically connected to the controller 601. Then, the controller 601 performs transmission and reception of various electrical information signals with respect to each block element, and manages processing concerning timing charts described below.

[Example Development Ghost Occurrence Mechanism]

Hereinafter, a mechanism for the occurrence of a development ghost and a relationship between the development ghost and the amount of collection of development residual toner by the supply roller 5 are described. In this regard, however, the development ghost in the present example embodiment refers to a phenomenon in which a halftone image printed after a blank image (an image in which no toner is transferred at all) is printed (hereinafter referred to as "after white printing") becomes higher in density than a halftone image printed after a solid black image is printed (hereinafter referred to as "after black printing").

The development ghost is caused by the fact that a difference between the toner charge amount after white printing and the toner charge amount after black printing causes a difference in the amount of toner used to develop an electrostatic latent image on the photosensitive drum 1. In the case of operation after black printing, since toner on the development roller 4 is consumed each time, the charge amount of toner having passed over the regulation member 8 is greatly attributed to the triboelectric charging ability of the regulation member 8.

On the other hand, in the case of operation after white printing, triboelectric charging between the supply roller 5 and the development roller 4 and triboelectric charging by the regulation member 8 are applied to development residual toner which is previously charged. Therefore, the toner charge amount after white printing is likely to become higher than the toner charge amount after black printing. Thus, the cause is that development residual toner would remain without being collected by the supply roller 5, and, if it is possible to increase the amount of development residual toner to be collected by the supply roller 5, the toner charge amount after white printing can be made closer to the toner charge amount after black printing. This enables decreasing a difference between the toner charge amount after black printing and the toner charge amount after white printing, thus reducing a development ghost.

To increase the amount of collection of development residual toner by the supply roller 5, it is effective to set an electric potential difference between the development roller 4 and the supply roller 5 in a direction to cause development residual toner to be urged to the supply roller 5, thus increasing the amount of collection of development residual toner by the supply roller 5. However, if an electric potential difference between the development roller 4 and the supply roller 5 is merely set in a direction to cause development residual toner to be urged to the supply roller 5 during image formation, the amount of toner supplied from the supply roller 5 to the development roller 4 may become insufficient. In other words, when an image with a high printing ratio, such as a solid image, is printed, the amount of supplied toner may become insufficient, so that a defect in which a solid image with an even density cannot be formed (solid-image followability defect) may be caused.

Therefore, at the time of an image non-forming region, such as at the time of preceding rotation and at the time of an inter-sheet interval, to increase the amount of collection of development residual toner by the supply roller 5 as measures taken against a development ghost, an electric potential difference between the development roller 4 and the supply roller 5 is set in a direction to cause toner to be urged to the supply roller 5. Then, at the time an image forming region, to increase the amount of toner to be supplied to the development roller 4 as measures taken against a solid-image followability defect, an electric potential difference between the development roller 4 and the supply roller 5 is set in a direction to cause toner to be urged to the development roller 4.

With the above-described bias control performed, the occurrence of a solid-image followability defect is prevented and, at the same time, the amount of collection of development residual toner by the supply roller 5 is increased, so that the occurrence of a development ghost can be reduced.

Furthermore, in the present example embodiment, a development device in which the respective surfaces of the development roller 4 and the supply roller 5 move in the same direction (in a parallel direction) at the abutment portions thereof (hereinafter referred to as a "with-development device") is used. In such a with-development device, since the respective surfaces of the development roller 4 and the supply roller 5 move in the same direction at the abutment portions thereof, mechanical supply force caused by sliding-contact and friction between them is also weak, so that a conspicuous development ghost may occur. However, even in a with-development device, performing the above-described bias control enables more appropriately reducing the occurrence of a development ghost.

[Example Image Missing at Trailing Edge of Image]

Next, image missing at the trailing edge portion of an image forming region (an upstream region in the conveyance direction of the recording material 12) is described. Image missing at the trailing edge portion of an image forming region is caused by rapidly changing setting of an electric potential difference between the development roller 4 and the supply roller 5 in a direction to cause development residual toner to be urged from the development roller 4 to the supply roller 5 during formation of an image with a high printing ratio, such as a solid image. In other words, setting a rapid electric potential difference in such a manner that toner moves from the development roller 4 to the supply roller 5 causes toner on the development roller 4 to become seriously insufficient. As a result, toner originally required for image formation becomes insufficient to be supplied to the development roller 4, so that image missing occurs.

Considering the above-mentioned circumstances, a method of preventing image missing at the trailing edge portion of an image forming region and, at the same time, reducing a development ghost is required.

In the present example embodiment, in an image forming apparatus in which an inter-recording material distance between adjacent recording materials during continuous printing is less than the circumferential length of the development roller 4, the amount of variation of an electric potential difference between the development roller 4 and the supply roller 5 per unit time is switched in such a manner that the electric potential difference becomes gradually smaller during image formation. Then, at least until the end of image formation, a bias which makes an electric potential difference in a direction to cause toner to be urged from the supply roller 5 to the development roller 4 is applied. After that, a bias to be applied to the supply roller 5 is controlled to make an electric potential difference in such a manner that a force for urging from the development roller 4 to the supply roller 5 acts on toner. As a result, a rapid change of the amount of supplied toner is prevented and the occurrence of image missing is prevented or reduced.

Hereinafter, various details of control and advantageous effects thereof are described with use of first and second example embodiments.

[Example Supply Roller Bias Control]

Figure 3:
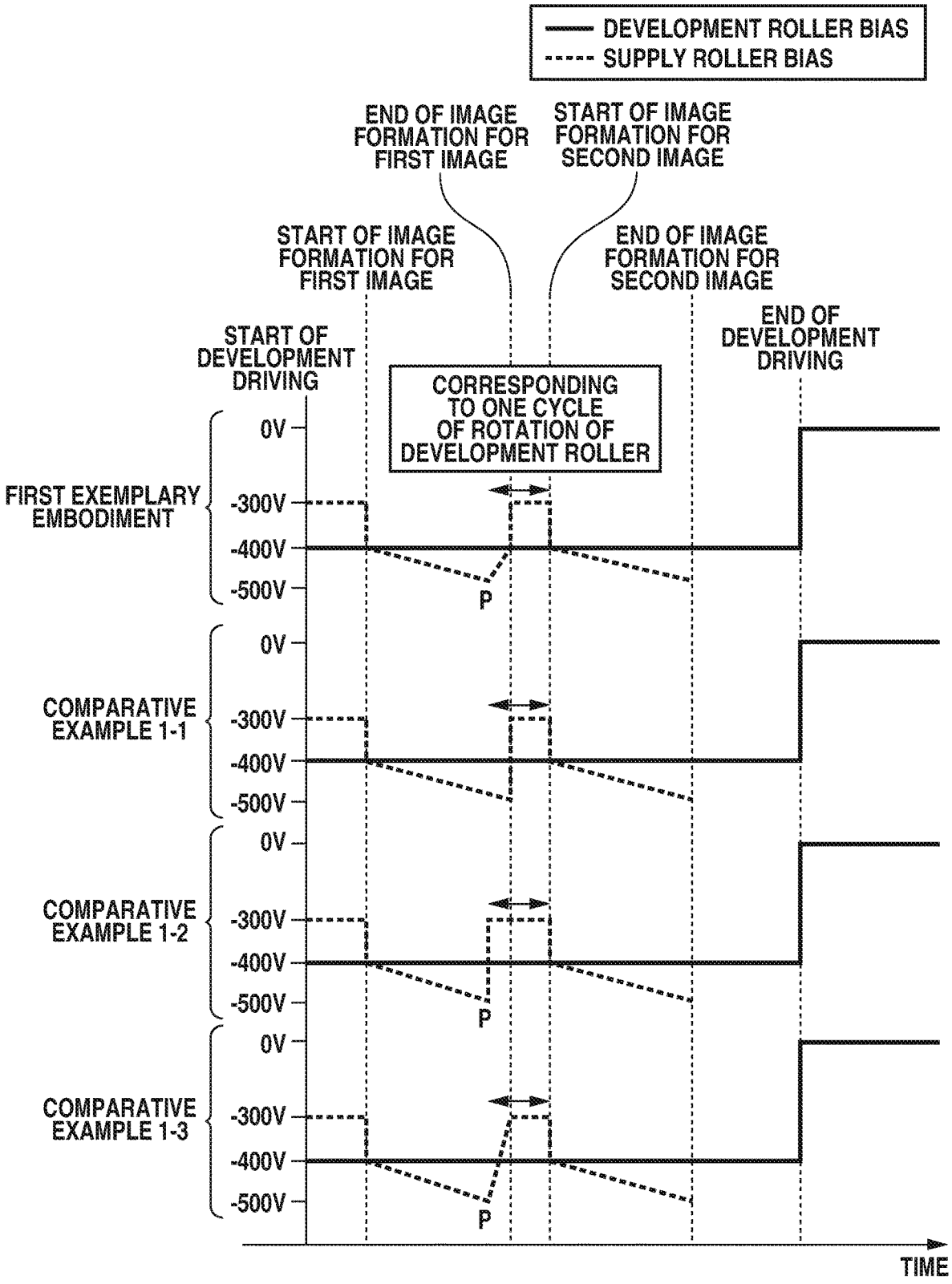
FIG. 3 is a timing chart of voltage control in a first example embodiment of the invention.

Bias control performed between the development roller 4 and the supply roller 5 in the first example embodiment is described with reference to FIG. 3. FIG. 3 is a timing chart illustrating bias control performed when multiple-sheet continuous printing is performed (here, when two-sheet continuous printing, in which printing is sequentially performed on a first recording material and a second recording material, is performed), while comparing the first example embodiment with other comparative examples.

A section from the start of image formation for the first image to the end of image formation for the first image is equivalent to a first image forming region corresponding to the first recording material. Moreover, a section from the start of image formation for the second image to the end of image formation for the second image is equivalent to a second image forming region corresponding to the second recording material. In each image forming region, a two-dimensional electrostatic latent image rasterized in a main scanning direction and a sub-scanning direction by the exposure device is formed on the photosensitive drum 1.

Then, with respect to a direction along which the first image forming region and the second image forming region are arranged, an interval between the first and second image forming regions is set equal to or less than the circumferential length of the development roller 4 or set less than the circumferential length thereof.

Here, each timing illustrated in the timing chart is described in detail. The following timing is each timing in the process of printing performed on one recording material 12 (during an image forming operation).

The start of development driving is timing at which, upon receiving drive force from the drive motor serving as a development driving unit (drive source "b"), the development roller 4 and the supply roller 5 have started rotation.

The start of image formation is writing start timing of laser exposure in the sub-scanning direction. The end of image formation is timing at which the laser exposure in the sub-scanning direction ends. The end of development driving is timing at which, when drive force from the drive motor serving as a development driving unit (drive source "b") is stopped from being supplied, the development roller 4 and the supply roller 5 have ended rotation.

However, each timing is not limited to the above-mentioned timing. For example, the start of image formation can be set to a predetermined time before writing start timing of laser exposure in the sub-scanning direction. Moreover, the end of image formation can also be set to, for example, a predetermined time after laser exposure end timing. Each timing can be changed in such a way as to become optimum according to configurations of the development device and the image forming apparatus.

Moreover, actually, a misalignment may occur between timing at which an electrostatic latent image in writing start/end timing of laser exposure in the sub-scanning direction reaches the development position and timing at which a contact point between the supply roller 5 and the development roller 4 at the time of changing of a bias to be applied to the supply roller 5 reaches the development position. In other words, a misalignment may occur between the position of changing of a bias to be applied to the supply roller 5 and the leading edge position/trailing edge position of an image formable region. The following description is made based on a case where such a misalignment does not occur or a case where the misalignment is of a negligible degree. However, in a case where the misalignment is of a negligible degree, the time after waiting for a time "t2−t1" from writing start/end timing of laser exposure can be set as timing at which to change a bias to be applied to the supply roller 5. Furthermore, in a case where t1 is larger than t2, it means waiting for a negative time, so that the timing of changing becomes earlier. Here, t1 denotes a time required until a contact point between the supply roller 5 and the development roller 4 at the time of changing of a bias to be applied to the supply roller 5 reaches the development position. Moreover, t2 denotes a time required until an electrostatic latent image in writing start/end timing of laser exposure in the sub-scanning direction reaches the development position.

The bias to be applied to the development roller 4 is a bias which is kept constant in a period from the start of development driving to the end of development driving, and is applied at −400 V in the first example embodiment.

In a period from the start of development driving to the start of image formation (hereinafter referred to as "preceding rotation"), a bias which is higher than a bias to be applied to the development roller 4 is applied to the supply roller 5 in such a manner that negatively-charged polarity toner is urged from the development roller 4 to the supply roller 5. This enables preventing or reducing unnecessary toner from being supplied onto the development roller 4, thus increasing the amount of toner collected by the supply roller 5, so that the charge amount of toner on the development roller 4 can be prevented or reduced from increasing at the time of preceding rotation.

Next, in a period from the start of image formation to a switching point P, which is located closer to the trailing edge side (upstream side) than the central part of an image forming region for the first recording material 12 in the conveyance direction, a bias to be applied to the supply roller 5 is made to have a slant. With this, to enlarge a force acting on toner to urge the toner from the supply roller 5 to the development roller 4, control is performed in such a manner that a bias to be applied to the supply roller 5 becomes gradually lower in such a way as to enlarge an electric potential difference with respect to a bias to be applied to the development roller 4.

Then, in a period from the switching point P in the process of image formation to the end of image formation for the first image, a bias to be applied to the supply roller 5 is changed in such a way as to have a different slant. With this, to make a force acting on toner smaller while maintaining the application of the force acting on toner to urge the toner from the supply roller 5 to the development roller 4, control is performed in such a way as to make the electric potential difference smaller without changing a magnitude relationship in bias between the supply roller 5 and the development roller 4.

With this, toner, starting with toner higher in responsiveness with respect to an electric potential difference between the development roller 4 and the supply roller 5, is gradually supplied from the supply roller 5 to the development roller 4, so that more than a necessary amount of toner can be prevented or reduced from being supplied from the supply roller 5 to the development roller 4 at the image leading edge side (downstream side). As a result, an increase in the toner charge amount after white printing can be prevented or reduced even in the process of image formation, so that a difference between the toner charge amount after white printing and the toner charge amount after black printing can be made smaller.

In the second half portion of an image, since a sufficient electric potential difference between the development roller 4 and the supply roller 5 is provided, a sufficient amount of supplied toner is supplied onto the development roller 4. As a result, even in a case where an image with a high printing ratio, such as an entire solid image, is printed, a solid-image followability defect due to the insufficiency of the amount of supplied toner does not occur, so that a high-quality image can be provided.

Moreover, in a trailing edge portion of the image forming region, starting with the switching point P, setting is performed such that an electric potential difference in a direction to cause toner to be urged from the supply roller 5 to the development roller 4 is made gradually smaller, and, at a point of time of the end of image formation, the same electric potential is reached. Thus, in a period from the switching point P to the end of image formation, control is performed in such a way as to weaken toner supply force to the development roller 4 little by little. In this way, until a point of time at which image formation has ended, a bias is set within a range in a direction to cause toner to be constantly urged from the supply roller 5 to the development roller 4, so that the occurrence of image missing due to the insufficiency of toner supplied onto the development roller 4 can be prevented.

Furthermore, in the first example embodiment, at the time of preceding rotation, a bias of −300 V is applied to the supply roller 5. Moreover, a bias to be applied at the start of image formation is set to −400 V, and a bias to be applied at the switching point P is set to −500 V. Furthermore, to cause a bias to reach −400 V at a point of time at which image formation has ended, control is performed to change a bias while keeping constant the amount of change per unit time of a bias to be applied to the supply roller 5 (hereinafter referred to as a "supply roller bias slant").

Moreover, the switching point P is set to such a position that, in the image forming region for the first recording material 12, the distance from the switching point P to the start position (the leading edge, in other words, the downstream end) of an image forming region for the second recording material 12 in the conveyance direction is equal to or larger than the circumferential length (equal to or larger than a length corresponding to one cycle of rotation) of the development roller 4. More specifically, now, assume a case where a distance between the trailing edge of an image forming region corresponding to the first recording material and the leading edge of an image forming region corresponding to the second recording material in a direction in which the image forming regions are arranged is 5 mm. At that time, control is performed in such a manner that the position of the switching point P is 16 mm away from the end position of the image forming region in the conveyance direction of the recording material 12.

Furthermore, bias control performed in a period from the switching point P to the end of image formation is not limited to control performed with a constant supply roller bias slant maintained. The supply roller bias slant is not limited to being subjected to a single change, but can be changed a plurality of times.

Figures 4A, 4B:
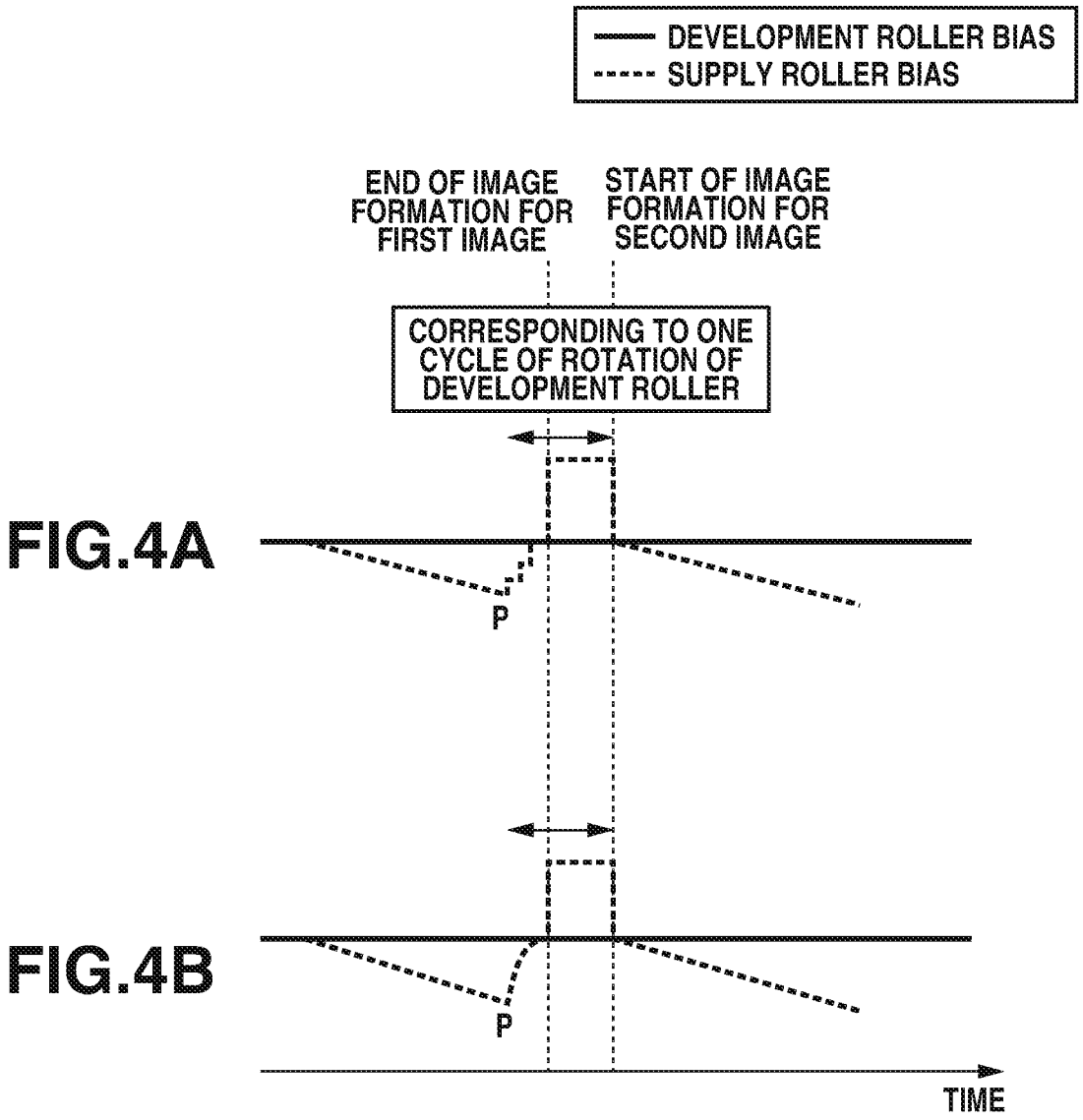
FIGS. 4A and 4B are timing charts of voltage control in a modification example of the first example embodiment of the invention.

FIGS. 4A and 4B illustrate timing patters in modification examples of control of a supply bias in the first example embodiment. FIG. 4A illustrates an example of control which changes an electric potential difference in a step-by-step manner starting with the switching point P. FIG. 4B illustrates an example of control which continuously changes an electric potential difference in such a manner that the supply roller bias slant depicts a sine curve. These are merely examples, and the control patterns are not limited to these. In the first example embodiment, as long as the amount of change of a supply roller bias is within 80 V/5 mm, trailing edge image missing can be prevented.

Furthermore, in a period from the end of printing on the recording material 12 for the first image to the start of printing on the recording material 12 for the second image, a bias to be applied to the supply roller 5 which is higher than a bias to be applied to the development roller 4 is applied. With this, negatively-charged polarity toner is urged from the development roller 4 to the supply roller 5. Since unnecessary toner can be prevented or reduced from being supplied to the development roller 4 and the amount of toner collected by the supply roller 5 can be increased, the charge amount of toner on the development roller 4 can be prevented or reduced from increasing at the time of preceding rotation. Then, in a period from the start of image formation for the second image, in other words, on the last recording material 12 in continuous printing, to the end of image formation for the second image, a bias to be applied to the supply roller 5 is made to have a slant, and is thus controlled to become gradually lower than a bias to be applied to the development roller 4. In this way, a force acting in such a way as to cause toner to be urged from the supply roller 5 to the development roller 4 is made larger. Thus, while, in image formation for the first image or image formation on the last recording material 12 in continuous printing, in a period from the start of image formation to the switching point P in the process of image formation, control is performed such that a bias to be applied to the supply roller 5 becomes gradually lower compared with a bias to be applied to the development roller 4, such control does not need to be performed with respect to the last recording material 12.

[Experiment]

Here, an experiment that was conducted to show advantageous effects of the first example embodiment is described.

The present experiment performed printing of images for evaluation in the environment of normal temperature and normal humidity conditions (temperature of 23° C. and humidity of 60%), and conducted the evaluation of a development ghost and image missing.

The determination of a development ghost was made with use of an evaluation image in which solid black patches of 5 mm×5 mm were arranged at intervals of 10 mm in a direction perpendicular to the conveyance direction at the sheet leading edge (downstream end) and a halftone image was printed following the solid black patches. In this image, a halftone image density at a portion following the solid black patches and a halftone image density at the other portion were measured with use of Spectordensitometer 500 manufactured by X-Rite, and ranking was performed based on the following criteria from differences in the measured density.

A: In a halftone image, the density difference is less than 0.04.

B: In a halftone image, the density difference is from 0.04 inclusive to less than 0.08.

C: In a halftone image, the density difference is equal to or greater than 0.08.

The evaluation of image missing was performed by outputting a solid black image and conducting the following evaluation based on a difference in density between an output leading edge (downstream end) and trailing edge of the solid black image with use of Spectordensitometer 500 manufactured by X-Rite. Furthermore, the printing test and the evaluation image were output in a monochromatic manner.

A: In an entire solid image, the density difference between the sheet leading edge and sheet trailing edge is less than 0.2.

B: In an entire solid image, the density difference between the sheet leading edge and sheet trailing edge is from 0.2 inclusive to less than 0.3.

C: In an entire solid image, the density difference between the sheet leading edge and sheet trailing edge is equal to or greater than 0.3.

Furthermore, with respect to comparative example 1-1, comparative example 1-2, and comparative example 1-3, illustrated in FIG. 3, serving as examples targeted for comparison with the advantageous effects of the first example embodiment, a similar experiment was performed to evaluate a development ghost and image missing. Comparative example 1-1 corresponds to a case where, only in a period between recording materials for the first image and the second image in continuous printing, control was performed in a direction to cause toner to be urged from the development roller 4 to the supply roller 5. Comparative example 1-2 corresponds to a case where, at a point of time of the switching point P, the supply roller bias was changed from −500 V to −300 V, so that control was performed in a direction to cause toner to be urged from the development roller 4 to the supply roller 5. In comparative example 1-3, in a period from the switching point P to the end of image formation, the slant of the supply roller bias was changed in such a manner that the supply roller bias became −300 V. In this way, comparative example 1-3 corresponds to a case where, in the process of image formation, control was performed for changing from a direction to cause toner to be urged from the supply roller 5 to the development roller 4 to a direction to cause toner to be urged from the development roller 4 to the supply roller 5. Results of the experiment are shown in Table 1.

TABLE 1

Image Levels of Two Images in Continuous Printing in First Example Embodiment

| | Development Ghost | Image Missing |
|---|---|---|
| First Example Embodiment | A | A |
| Comparative Example 1-1 | C | A |
| Comparative Example 1-2 | A | C |
| Comparative Example 1-3 | A | B |

In a case where control in comparative example 1-1 was performed, only in a period between recording materials for the first image and the second image in continuous sheet feeding, control was performed in a direction to cause toner to be urged from the development roller 4 to the supply roller 5. In this case, since the period was shorter than the circumferential length of the development roller 4, the amount of collection of toner to be collected from the development roller 4 to the supply roller 5 was not sufficient. As a result, since the toner charge amount after white printing increased and a difference between the toner charge amount after black printing and the toner charge amount after white printing widened, a development ghost occurred.

Moreover, in a case where control in comparative example 1-2 was performed, at a point of time of the switching point P, control was performed to change the supply roller bias from −500 V to −300 V. In this case, at the time of switching of a supply bias, toner was urged from the development roller 4 to the supply roller 5. As a result, performing the above-mentioned control in the process of image formation caused a phenomenon in which the amount of toner supplied to the development roller 4 decreased, so that image missing occurred.

Furthermore, in a case where control in comparative example 1-3 was performed, in a period from the switching point P to the end of image formation, control was performed to change the slant of the supply roller bias in such a manner that the supply roller bias became −300 V from −500 V. In this case, in the process of image formation, control was performed for changing from a direction to cause toner to be urged from the supply roller 5 to the development roller 4 to a direction to cause toner to be urged from the development roller 4 to the supply roller 5. In other words, the polarity of a supply roller bias with respect to the development roller 4 was reversed from minus to plus. As a result, while the level of image missing was made better than comparative example 1-2, performing the above-mentioned control in the process of image formation caused a phenomenon in which the amount of toner supplied to the development roller 4 decreased, so that image missing occurred.

On the other hand, in a case where control in the first example embodiment was performed, the advantageous effects described above were obtained, so that the occurrence of a development ghost was able to be prevented or reduced without causing image missing.

Furthermore, in the first example embodiment, a case where such electric potential difference control as to weaken toner holding force of the development roller 4 little by little is performed in the process of image formation for the first image at the time of continuous printing for two images has been described. However, the first example embodiment is not limited to this case, but similar control can be performed even at the time of image formation and in a period between recording materials in a case where continuous printing for two or more images is performed. In this regard, however, an electric potential difference between the development roller 4 and the supply roller 5 at the time of preceding rotation and an electric potential difference between the development roller 4 and the supply roller 5 in a period between sheets can be set to respective different values.

In the first example embodiment, in control performed in a period from the switching point P to the end of image formation and in a period from a point between recording materials to the start of image formation for the second image, toner holding force of the development roller 4 is weakened little by little. Then, after that, an electric potential difference between the development roller 4 and the supply roller 5 is set in such a manner that a force acts to urge toner from the development roller 4 to the supply roller 5, but the first example embodiment is not limited to this.

For example, in a period from the end of image formation for the first image to the start of image formation for the second image, within a range effective against a development ghost, an electric potential difference between the development roller 4 and the supply roller 5 can be optionally set. As long as both a development ghost at the time of continuous sheet feeding and trailing edge image missing at the time of printing of a high-printing-ratio image do not occur, optimum setting of various configurations can be performed.

As described above, according to the first example embodiment of the disclosure, in a configuration in which a distance between adjacent recording materials at the time of continuous printing is set shorter than the circumferential length of the development roller 4, both a reduction in a development ghost and the prevention of image missing at an image trailing edge portion can be satisfied.

In a second example embodiment, control which is performed to change the supply roller bias slant a plurality of times at predetermined timing in the process of image formation is described. Furthermore, in the description of the second example embodiment, portions similar to those in the above-described first example embodiment are omitted from description.

Advantageous effects of this control are conspicuously seen in a case where an image likely to cause a development ghost is printed on the second half portion of a recording material, and performing control in the second example embodiment enables reducing the occurrence of a development ghost even in a case where such an image is printed.

Figure 5:
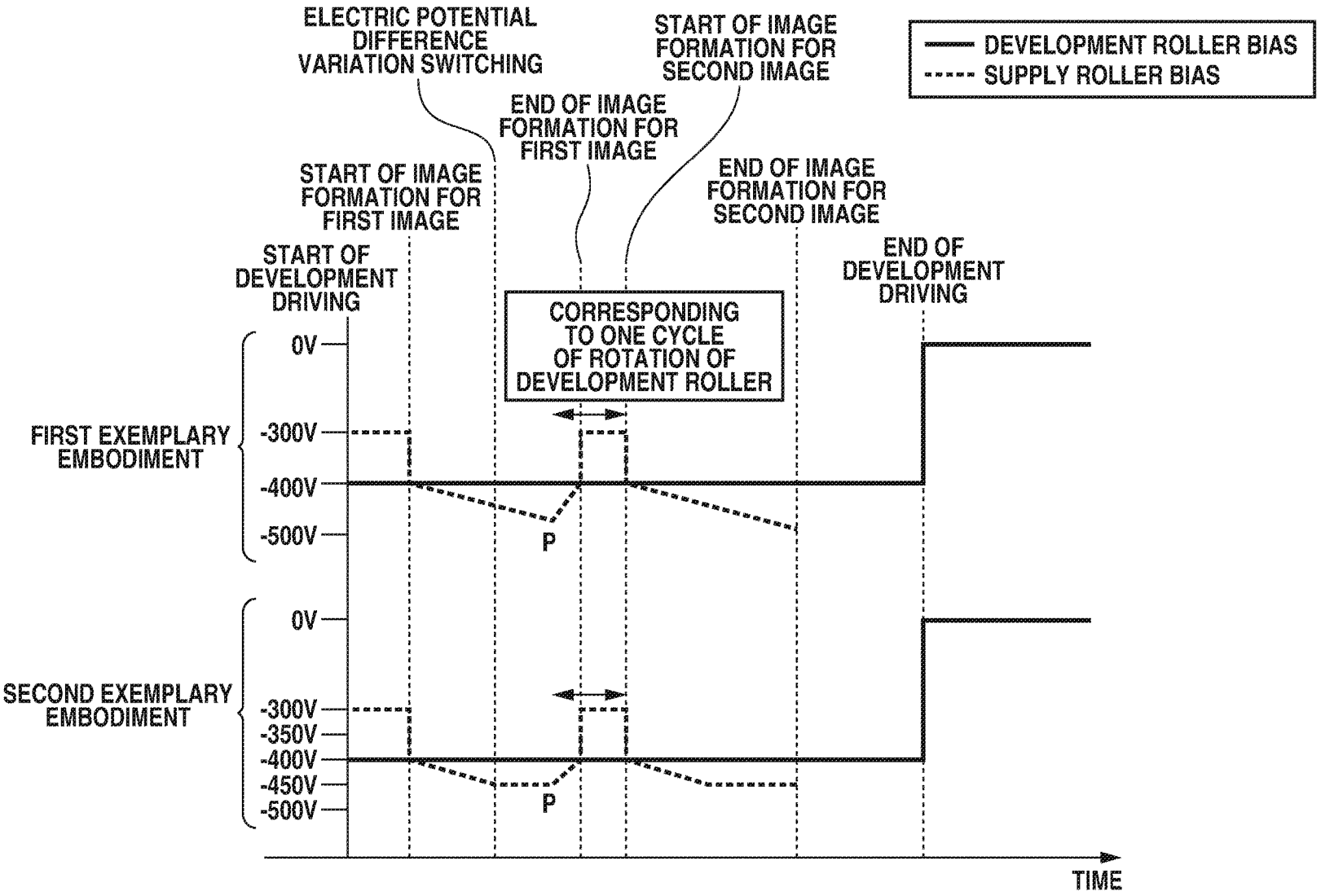
FIG. 5 is a timing chart of voltage control in a second example embodiment of the invention.

Hereinafter, control performed in the second example embodiment is described with reference to the timing chart of FIG. 5.

At predetermined timings in a period from the start of image formation to the end of image formation, a plurality of electric potential difference variation switching timings is set. The supply roller bias slant is varied between a period from the start of image formation to electric potential difference variation switching timing and a period from the electric potential difference variation switching timing to the switching point P. More specifically, the supply roller bias slant in the period from the electric potential difference variation switching timing to the switching point P is set smaller than the supply roller bias slant in the period from the start of image formation to the electric potential difference variation switching timing. Performing this control enables reducing the toner supply amount for the second half portion of an image, so that, even when toner become likely to be supplied, the occurrence of a development ghost can be reduced.

Furthermore, in the second example embodiment, the electric potential difference variation switching timing is provided 0.6 seconds after the start of image formation. Moreover, a bias to be applied to the supply roller 5 at the start of image formation is set to −400 V, and a bias to be applied to the supply roller 5 at the electric potential difference variation switching timing is set to −450 V. Additionally, in a period from the electric potential difference variation switching timing to the switching point P, control is performed in such a way as to apply a constant bias of −450 V to the supply roller 5. The supply roller bias slant in a period from the switching point P to the end of image formation is set to be gradually changed in such a manner that a bias of −400 V is applied to the supply roller 5 at the end of image formation.

Experiment

An experiment that was conducted to show advantageous effects of the second example embodiment is herein now described.

The present experiment performed printing of images for evaluation in the environment of normal temperature and normal humidity conditions (temperature of 23° C. and humidity of 60%), and conducted the evaluation of a development ghost and image missing.

The evaluation of a development ghost in the second example embodiment was performed with use of a development ghost determination image in the first half portion (downstream side) of the recording material 12 for the first image and a development ghost determination image in the second half portion (upstream side) of the recording material 12 for the first image. As the development ghost determination image in the first half portion (downstream side) of the recording material 12, an evaluation image in which solid black patches of 5 mm×5 mm were arranged at intervals of 10 mm in a direction perpendicular to the conveyance direction at the sheet leading edge (downstream end) and a halftone image was formed following the solid black patches was used. Moreover, as the development ghost determination image in the second half portion (upstream side) of the recording material 12, an evaluation image in which solid black patches were arranged at the position of 150 mm from the leading edge of the recording material 12 and a halftone image was formed following the solid black patches was used. In this way, with use of the development ghost determination image in the first half portion of the recording material 12 and the development ghost determination image in the second half portion of the recording material 12, the evaluation of the occurrence of a development ghost in the first half portion and the second half portion of the recording material 12 was conducted. In addition to this evaluation, the trailing edge side (upstream side) of the halftone image of each of the evaluation images was checked and the evaluation of the occurrence of image missing was conducted.

Results of this experiment are shown in Table 2.

TABLE 2

Image Levels in Timing Chart in Second Example Embodiment

| | Development Ghost | | |
|---|---|---|---|
| | Front Half Portion | Second Half Portion | Image Missing |
| First Example Embodiment | A | C | A |
| Second Example Embodiment | A | B | A |

In a case where control in the first example embodiment was performed, the occurrence of a development ghost in the first half portion of the recording material was able to be prevented or reduced, but a conspicuous development ghost occurred in the second half portion of the recording material. This was because toner was supplied to the development roller 4 more than necessary up to the second half portion of the recording material and the insufficiency of collection of development residual toner by the supply roller 5 occurred, so that the toner charge amount increased and a difference between the toner charge amount after white printing and the toner charge amount after black printing widened.

On the other hand, in a case where control in the second example embodiment was performed, an increase in the toner charge amount on the development roller 4 up to the second half portion of the recording material was prevented or reduced, so that a development ghost occurring even in the second half portion of the recording material was able to be more reduced.

Furthermore, in the second example embodiment, electric potential difference variation switching timing is provided in a period for image formation, and control to switch the supply roller bias slant at this timing is performed. However, the second example embodiment is not limited to this, but control to continuously vary the supply roller bias slant in a period from the start of image formation to the switching point P can be performed. Moreover, a plurality of electric potential difference variation switching timings can be set and the supply roller bias slant can be varied a plurality of times.

As described above, according to the above disclosure, in a configuration in which a distance between adjacent recording materials at the time of continuous printing is set shorter than the circumferential length of the development roller, both a reduction in a development ghost occurring in an image forming region and the prevention of image missing occurring at the trailing edge portion of the image forming region can be satisfied.

While the present disclosure has been described with reference to numerous example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Applications No. 2017-077614 filed Apr. 10, 2017, and No. 2018-041225 filed Mar. 7, 2018, which are hereby incorporated by reference herein in their entirety.

What is claimed is:

1. An image forming apparatus comprising:

a rotatable developer bearing member configured to bear a developer;

a development bias application unit that applies, to the developer bearing member, a development bias used to develop an electrostatic latent image;

a supply roller to which a supply bias is applied by a supply bias application unit to supply the developer to the developer bearing member, the image forming apparatus being capable of forming an image in each of a first image forming region which corresponds to a first recording material and a second image forming region which is located at an interval less than a circumferential length of the developer bearing member and corresponds to a second recording material which is conveyed following the first recording material; and a control unit that controls an electric potential difference between the developer bearing member and the supply roller in such a manner that force in a direction from the supply roller toward the developer bearing member acts on the developer in a section of an image forming region extending from a leading edge of the first image forming region toward a trailing edge thereof, wherein the control unit controls an electric potential difference between the developer bearing member and the supply roller in such a manner that force in a direction from the supply roller toward the developer bearing member acting on the developer becomes smaller in a section extending from a switching point, which is located at a position obtained by returning from a leading edge of the second image forming region to the first image forming region by a distance equal to or greater than the circumferential length of the developer bearing member, to the trailing edge of the first image forming region.

2. The image forming apparatus according to claim 1, wherein the supply roller moves in a parallel direction with the developer bearing member at an abutment portion with respect to the developer bearing member.

3. The image forming apparatus according to claim 1, wherein the control unit performs control to switch an amount of change per unit time of an electric potential difference between the developer bearing member and the supply roller a plurality of times in a process of image formation.

4. The image forming apparatus according to claim 1, wherein the control unit gradually varies an electric potential difference between the developer bearing member and the supply roller in a period from the switching point in such a manner that the electric potential difference becomes close to zero, and, after ending of image formation on the first recording material, controls the supply bias in such a manner that force for causing the developer to move from the developer bearing member to the supply roller acts.

5. The image forming apparatus according to claim 1, wherein an amount of change per unit time of the supply bias varies in a step-by-step manner.

6. The image forming apparatus according to claim 1, wherein the development bias application unit applies a development bias having a constant magnitude over a period of image formation extending from the first recording material to the second recording material, and wherein the supply bias application unit applies a supply bias which varies in such a manner that a difference in absolute value from the development bias becomes gradually larger in a period of image formation for each of the first recording material and the second recording material.

7. The image forming apparatus according to claim 1, wherein, in a section from the trailing edge of the first image forming region for the first recording material to the leading edge of the second image forming region for the second recording material, the supply bias application unit applies a supply bias having such a magnitude that a polarity of a value obtained by subtracting the supply bias from the development bias becomes a polarity opposite to a normal charging polarity of the developer.

8. The image forming apparatus according to claim 1, wherein the developer is negative in normal charging polarity, wherein the control unit performs control such that, in a period from a downstream end of an image forming region for the first recording material to the switching point, a difference between the development bias in negative polarity and the supply bias in negative polarity becomes gradually larger, and wherein the control unit performs control such that, in a period from the switching point for the first recording material to a downstream end of an image forming region for the second recording material, a difference between the development bias in negative polarity and the supply bias in negative polarity becomes gradually smaller.

9. The image forming apparatus according to claim 1, wherein the switching point is located distant from the leading edge of the second image forming region by equal to or greater than the circumferential length and less than twice the circumferential length of the developer bearing member in a direction along which the first image forming region and the second image forming region are located.

* * * * *